United States Patent [19]

Okazaki et al.

[11] Patent Number: 4,605,609

[45] Date of Patent: Aug. 12, 1986

[54] IMAGE RECEIVING MATERIAL WITH LOW CALCIUM GELATIN

[75] Inventors: Koji Okazaki; Yasuo Tsubai; Kimihisa Hamazoe, all of Nagaokakyo, Japan

[73] Assignee: Mitsubishi Paper Mills, Ltd., Chiyoda, Japan

[21] Appl. No.: 643,027

[22] Filed: Aug. 21, 1984

[30] Foreign Application Priority Data

Sep. 9, 1983 [JP] Japan ..... 58-166185
Dec. 26, 1983 [JP] Japan ..... 58-247118

[51] Int. Cl.[4] ..... G03C 5/54

[52] U.S. Cl. ..... 430/232; 430/233; 430/247; 430/642

[58] Field of Search ..... 430/232, 231, 247, 642, 430/233, 491; 106/127, 137

[56] References Cited

U.S. PATENT DOCUMENTS

| | | | |
|---|---|---|---|
| 2,191,206 | 2/1940 | Schwartz | 106/125 |
| 3,647,440 | 3/1972 | Rasch | 430/232 |
| 3,655,412 | 4/1972 | Kumai et al. | 106/135 |
| 4,301,238 | 11/1981 | Miyazawa et al. | 430/642 |
| 4,429,038 | 1/1984 | Moll et al. | 430/510 |

*Primary Examiner*—Richard C. Schilling
*Attorney, Agent, or Firm*—Cushman, Darby & Cushman

[57] ABSTRACT

Disclosed is an image receiving material for silver complex diffusion transfer process which contains gelatin having a calcium content of about 1,000 ppm or less. This image receiving material provides improved silver image density. Further improvement can be attained when said gelatin has a jelly strength of 280 g or above.

14 Claims, No Drawings

IMAGE RECEIVING MATERIAL WITH LOW CALCIUM GELATIN

BACKGROUND OF THE INVENTION

This invention relates to a silver complex diffusion transfer material in which a photosensitive material and an image receptive material are combined. It relates, more particularly, to an improvement of said image receptive material.

The silver complex diffusion transfer process generally involves, as essential materials, a photosensitive material comprising a support and, provided thereon, a silver halide emulsion layer which serves as photosensitive layer, an image receptive material comprising a support and, provided thereon, an image receptive layer containing physical development nuclei, and a processing composition containing a solvent for the silver halide. The silver complex diffusion transfer process proceeds, in principle, in a manner such that upon exposure the silver halide of the exposed areas in a photosensitive layer is developed with a processing composition or a developing agent in the photosensitive material, while, at the same time, the silver halide in the unexposed areas reacts with a silver halide solvent in the processing composition, forming a soluble silver complex which diffuses into an image receptive material and deposits on the physical development nuclei in the image receptive layer, forming a silver image. This process is widely utilized in copying documents such as prints, hand-written documents, and design drawings. For such purposes the process is required to be able to reproduce the image faithfully to the original. It is important for the image receptive material to exhibit such essential properties as high optical density (both reflection and transmission densities) and good tone (blue black tone being generally preferred) of the silver image, high rate of diffusion transfer, and sufficient film strength of the image receptive layer. Above all, the optical density (both reflection and transmission densities) of silver image is a very important quality. Copies are generally required to be of high sharpness resulting from a high density of the silver image. In the case of block copy, a high density of the silver image is preferred for the faithful reproduction of the image quality (fine lines and dots).

As described above, it is not too much to state that the performance characteristics of an image receptive material depend largely upon the optical density of silver image. For this reason, research and development of an image receptive material which may afford a high density silver image are being actively in progress in the art.

In the sensitive material used in common black and white photography, the directly developed silver halide grains determine the silver image density, whereas in the silver complex diffusion transfer process, the enviromental conditions under which the soluble silver complex is developed within the image receptive layer seem also to affect greatly the silver image density.

SUMMARY OF THE INVENTION

The present inventors carried out an extensive study on the basis of above consideration to improve the silver image density of an image receptive material in the silver complex diffusion transfer process. As a result, they are succeeded in improving the silver image density, which is the primary object of this invention, by the use of a gelatin mentioned hereunder as the binder of image receptive layer.

DESCRIPTION OF THE INVENTION

The first improvement step is attained by the image receptive material which employs as the binder a gelatin having a calcium content of 1,000 ppm or less. A more desirable embodiment of this invention is realized in the image receptive material containing a gelatin having a calcium content of about 1,000 or less and a jelly strength of 280 g or above, as determined by the method of PAGI. The jelly strength of 280 g or above is referred to a jelly strength as determined by the method of PAGI described in "Testing methods for photographic gelatin," p. 8 (published by Commission on Testing Methods for Photographic Gelatin, 1982).

Gelatin is generally produced from collagen, a major constituent of skin, bones, etc., of animal origin, by solubilizing it in boiling water. It is difficult, however, to extract directly the raw material with boiling water. In the commercial process, the raw material is pretreated by soaking in milk of lime for 1 to 3 months. Collagen is partially hydrolyzed during this long-term pretreatment called liming. The gelatin used in this invention is derived from cattle bones used as raw material. One half or more of the cattle bones is inorganic matters, mostly calcium phosphate. Removal of calcium phosphate by converting it, with dilute hydrochloric acid, into soluble calcium dihydrogen phosphate leaves behind ossein containing insoluble collagen as major constituent. If the treatment with hydrochloric acid is prolonged to remove completely the calcium phosphate, the hydrolytic loss of the necessary ossein becomes appreciable. Therefore, the hydrochloric acid treatment is performed under optimum conditions. After the acid treatment, the lime-treated gelatin still contains appreciable amount of calcium and other inorganic matters. The commercial common photographic gelatin contains 3,000 to 5,000 ppm of calcium and other inorganic salts.

The present inventors continued the research on the purified gelatin free of calcium and other inorganic salts and, as a result, found that the calcium salt exerts an adverse effects on the optical density of transferred silver and that a high-density silver image is obtained by decreasing the calcium content of the image receptive layer to about 1,000 ppm or less, preferably about 500 ppm or less.

In the image receptive layer of conventional silver complex diffusion transfer photographic materials, gelatin, especially lime-treated gelatin, has been widely used as the binder. Nevertheless, the jelly strength of the gelatin being used as the binder has been seldom paid special attention (a lime-treated gelatin having a jelly strength of 250 g or less have been generally used). In the second improvement step, therefore, the present inventors tried to use gelatins having various jelly strengths as the binder of image receptive layer. It was found that the jelly strength affects the optical density of the silver image in the image receptive layer formed by the diffusion transfer, the density tending to become higher with the increase in jelly strength of the gelatin. For instance, when two types of gelatins having jelly strengths of 250 g or below and 280 g or above were used, the optical density of the silver image formed in the latter case was distinctly higher. On the basis of the above finding, it is concluded that in order to achieve the object of this invention, an effective means is the employment of a gelatin having a high jelly strength as the binder in an image receptive layer of the image receptive material.

A gelatin of high jelly strength has another advantage in that when it is used as binder, an image receptive layer of high film strength is easily obtained and the film strength is further improved to a very high level by use of a hardener. However, a high film strength brings about a decline in optical density of the silver image. It was found that when a gelatin having a high jelly strength and a low calcium content is used as the binder in an image receptive layer, there is obtained an image receptive material having a high film strength and yet capable of forming a silver image of sufficiently high density, as shown later in Examples.

As described previously with regard to the first improvement step, the image receptive layer having a sufficiently low calcium salt content is produced by the use of a gelatin having a calcium content of about 1,000 ppm or less as the sole binder. The image receptive material is further improved by using a gelatin having a jelly strength of 280 g or more and a calcium content of about 1,000 ppm or less as the sole binder of the image receptive layer. However, so long as the calcium content of the gelatin of an image receptive layer will remain at about 1,000 ppm or less, or the calcium content will remain at about 1,000 ppm or less and the jelly strength at 280 g or more, the gelatin can be used in combination with common gelatin or other binders including hydrophilic synthetic resins such as, for example, polyvinyl alcohol, partially saponified polyvinyl acetate, maleic anhydride copolymers (e.g. styrene-maleic anhydride copolymer, ethylene-maleic anhydride copolymer, isobutylene-maleic anhydride copolymer, vinyl methyl ether-maleic anhydride copolymer, and vinyl acetate-maleic anhydride copolymer), products formed by heating maleic anhydride copolymers with polyvinyl alcohol, polyacrylamide, polyacrylic acid, poly-N-vinylpyrrolidone, synthetic resins produced by emulsion polymerization (e.g. homo- or copolymers of polyacrylate esters, polyacrylic acid, polymethacrylic acid, polymethacrylate esters, polystyrene, and polybutadiene), carboxymethylcellulose, hydroxyethylcellulose, sodium alginate, dextran, gum arabic, agar, starch and derivatives thereof. A desirable amount of the gelatin of this invention is about one-third or more, preferably two-thirds or more, of the total binder in an image receptive layer.

The image receptive layer of the present image receptive material can be hardened with suitable hardeners. Examples of individual hardeners include aldehyde compounds such as formaldehyde and glutaraldehyde; ketone compounds such as diacetyl and cyclopentanedione; bis(2-chloroethylurea)-2-hydroxy-4,6-dichloro-1,3,5-triazine; compounds having reactive halogen atoms such as those described in U.S. Pat. No. 3,288,775; divinylsulfone; compounds having olefinic groupings such as those described in U.S. Pat. No. 3,635,718; N-methylol compounds such as those described in U.S. Pat. No. 2,732,316; isocyanates such as those described in U.S. Pat. No. 3,103,437; aziridine compounds described in U.S. Pat. No. 3,017,280 and 2,983,611; carbodiimide compounds such as those described in U.S. Pat. No. 3,100,704; epoxy compounds such as those described in U.S. Pat. No. 3,091,537; halogenocarboxyaldehydes such as mucochloric acid; dioxane derivatives such as dihydroxydioxane; and inorganic hardeners such as chrome alum, potassium alum, and zirconium sulfate. These hardeners are used each alone or in combinations.

The substances used as physical development nuclei in an image receptive layer of the present image receptive material are metals such as silver, gold, platinum, palladium, copper, cadmium, lead, cobalt, and nickel and sulfides or selenides thereof. These substances in colloidal form are preferred.

The image receptive layer may contain surface active agents such as natural surface active agents, e.g. saponin; nonionic surface active agents such as alkylene oxides, glycerols, and glycidols; cationic surface active agents such as higher-alkylamines, quaternary ammonium salts, heterocyclics (e.g. pyridine), and sulfonium compounds; anionic surface active agents containing said groups such as carboxylic acids, sulfonic acids, phosphoric acids, sulfate esters, and phosphate esters; amphoteric surface active agents such as amino acids, aminosulfonic acids, and sulfate or phosphate esters of aminoalcohols; anionic or amphoteric surface active agents of the fluoro compound type; matting agents; fluorescent dyes; anti-discoloration agents; toning agents such as typically 1-phenyl-5-mercaptotetrazole and other compounds described in "Photographic Silver Halide Diffusion Process," p. 61 (published by Focal Press Co.); developing agents e.g. hydroquinone and derivatives thereof, 1-phenyl-3-pyrazolidone and derivatives thereof; and silver halide solvents, e.g. sodium thiosulfate, ammonium thiosulfate, sodium thiocyanate, and potassium thiosulfate. The image receptive layer may be provided with an overlayer of lime-treated gelatin, acid-treated gelatin, hydroxycellulose, carboxymethyl-cellulose, pullulan, and sodium alginate. On the underside of the image receptive layer, there may be provided a neutralization layer and a subbing layer to secure tight adhesion to the support.

In preparing the image receptive material of this invention, the image receptive layer is applied by the customary techniques such as, for example, air-knife coating, extrusion coating, and curtain coating. Although the conditions (temperature and dew point temperature) for the drying of coating are not strictly limited, it is preformed preferably by first setting the gelatin at a temperature of 20° C. or below, and then allowing it to dry.

The silver halide emulsion used in a photosensitive layer of the photosensitive material from which the silver halide is transferred by diffusion to the image receptive material of this invention is any of those customarily used in the diffusion transfer process and the composition of emulsion is not subject to any strict restriction, so long as the silver halide can be developed and can diffuse in the exposed and unexposed portions, respectively, at a rate necessary for the diffusion transfer process. Suitable silver halides include bromide, iodide, chloride, chlorobromide, iodobromide, and chloroiodide of silver and mixtures thereof. The emulsion can be chemically and spectrally sensitized in a customary manner. The binders of the photosensitive layer are those polymeric substances which are usually used in silver halide emulsions. Examples of suitable binders include lime-treated gelatin, acid-treated gelatin, phthalated gelatin, acylate gelatin, phenylcarbamylated gelatin, polyvinyl alcohol, partially saponified polyvinyl acetate, polyacrylamide, poly-N-vinylpyrrolidone, hydroxyethylcellulose, carboxymethylcellulose, products formed by heating polyvinyl alcohol with maleic anhydride copolymers such as, for example, styrene-maleic anhydride copolymer and ethylene-maleic anhydride copolymer, synthetic resins produced by emulsion polymerization such as, for example, polyacrylate esters, polymethacrylate esters; homo- or copolymers of acrylic acid, methacrylic acid, butadiene, and styrene.

The photosensitive layer can be hardened with a suitable hardener described previously in connection with the image receptive layer. Further, the photosensitive layer may contain those additives which are generally used in silver halide photosensitive materials, such as, for example, surface active agents, antifoggants, matting agents, fluorescent dyes, and developing agents, e.g. hydroquinone and derivatives thereof, and 1-phenyl-3-pyrazolidone and derivatives thereof. The photosensitive layer can be provided with an overlayer of lime-treated gelatin, acid-treated gelatin, hydroxyethylcellulose, carboxymethyl-cellulose, pullulan and sodium alginate on the top and an atihalation layer on the underside.

The silver complex diffusion transfer process is generally carried out by using a photographic material of the "monosheet" type in which the image receptive material is additionally provided with photosensitive layer or by using that of the "two-sheet" type in which the photosensitive layer and the image receptive layer are provided on separate supports, forming two sheets, the photosensitive material and the image receipt material which, before use, are brought into close contact in superposition by means of a pair of rollers and are separated after completion of the diffusion transfer. The image receptive material of the present invention is adaptable to both types.

The silver complex diffusion transfer processing composition for the treatment of photographic material comprising the image receptive material of this invention can be a common silver complex diffusion transfer processing composition comprising a developing agent to develop the exposed silver halide, such as, for example, hydroquinone, a derivative thereof, 1-phenyl-3-pyrazolidone, or a derivative thereof; a solvent for the undeveloped silver halide, such as, for example, sodium thiosulfate, ammonium thiosulfate, sodium thiocyanate, or potassium thiocyanate; a preservative such as sodium sulfite; a development restrainer such as potassium bromide; and a toning agent such as 1-phenyl-5-mercaptotetrazole.

The support for the image receptive material according to this invention is a plastic film such as polystyrene, polycarbonate, cellulose triacetate, or polyethylene terephthalate, polyethylene terephthalate laminated paper sheet,or baryta paper sheet.

The invention is illustrated below in detail with reference to Examples.

EXAMPLE 1

A polyethylene laminated paper sheet of 90 g/m$^2$ in basis weight, which had been treated with corona discharge, was coated with the following coating composition at a coverage of 2 g/m$^2$ and dried to obtain an image receptive material. The test specimen of this material was conditioned at 70% RH for 24 hours and heated at 40° C. for 7 days.

| | |
|---|---|
| Gelatin A | 20 g |
| Water | 300 ml |
| Nickel sulfide colloidal solution (5 mM/liter) | 40 ml |

-continued

| | |
|---|---|
| 1-Phenyl-5-mercaptotetrazole (1% methanol solution) | 10 ml |
| 2,4-dichloro-6-hydroxy-S—triazine sodium salt (5% aqueous solution) | 4 ml |
| Sodium dodecylbenzenesulfonate (5% aqueous solution) | 10 ml |
| Adjusted to pH 6 | Total 400 g |

Gelatin A was a lime-treated gelatin of 4,100 ppm in calcium content. Gelatin A was desalted to various degrees to obtain gelatin samples of 1,800 (gelatin B), 740 (gelatin C), and 270 (gelatin D) ppm in calcium content. Other image receptive materials were prepared in the same manner as described above, except that gelatin samples B, C and D were used in place of the gelatin A.

A photosensitive material was prepared by providing on a polyethylene laminated paper sheet consecutively an undercoating containing carbon black to serve as an antihalation layer, and a gelatino silver halide emulsion layer containing 1.5 g/m$^2$ (in terms of silver nitrate) of orthochromatically sensitized silver chlorobromide (5 mole-% in silver bromide content) having an average grain size of 0.3$\mu$, 0.2 g/m$^2$ of 1-phenyl-3-pyrazolidone, 0.7 g/m$^2$ of hydroquinone, and 4 g/m$^2$ of gelatin. The silver halide emulsion layer was hardened with a hardener to keep the layer from any damage during the diffusion transfer processing. A diffusion transfer processing solution of the following composition was used.

| | |
|---|---|
| Water | 800 ml |
| Sodium hydroxide | 25 g |
| Anhydrous sodium sulfite | 100 g |
| Hydroquinone | 20 g |
| 1-Phenyl-3-pyrazolidone | 1 g |
| Potassium bromide | 3 g |
| Sodium thiosulfate | 30 g |
| 1-Phenyl-5-mercaptotetrazole | 0.1 g. |
| Made up with water to | 1,000 ml |

The photosensitive material was correctly exposed in a process camera through an original bearing moderately distributed black areas. The emulsion layer of the photosensitive material and the image receptive layer of the image receptive material were brought into close contact and the resulting assembly was passed through a processor provided with squeeze rolls and containing the diffusion transfer processing solution. Thirty seconds after the assembly had emerged from the squeeze rolls, the materials were pulled apart. The image receptive material was washed with water for about 30 seconds and dried. The reflection density of the black areas was measured by means of a reflection densitometer RD 519 of Macbeth Co.

| Gelatin | Reflection density |
|---|---|
| A | 1.54 |
| B | 1.57 |
| C | 1.63 |
| D | 1.65 |

EXAMPLE 2

An image receptive material was prepared in the same manner as in Example 1, except that the coating composition was coated on a polyethylene terephthalate film. The results of density measurement by means of a transmission densitometer TD 504 of Macbeth Co. were as shown below.

| Gelatin | Transmission density |
|---|---|
| A | 3.43 |
| B | 3.50 |
| C | 3.78 |
| D | 3.84 |

From the results of Examples 1 and 2, it is apparent that both reflection and transmission densities were improved with the decrease in calcium content of gelatin, the improvement becoming marked when the calcium content was decreased below 1,000 ppm.

EXAMPLE 3

An image receptive material was prepared by coating the following composition on the supports used in Examples 1 and 2.

| | |
|---|---|
| Gelatin | 16 g |
| Water | 250 ml |
| Products formed by heating 10% polyvinyl alcohol solution with ethylene-maleic anhydride copolymer [described in Japanese Patent Application "Kokai" (Laid-open) No. 9,646/80] | 40 g |
| Silver sulfide colloidal solution (5 mM/liter) | 40 ml |
| 1-Phenyl-5-mercaptotetrazole (1% methanol solution) | 10 ml |
| Formalin (5% aqueous solution) | 8 ml |
| Sodium lauryl sulfate (5% aqueous solution) | 10 ml |
| Adjusted to pH 5.5 | (Total 400 g) |

Test results obtained when gelatin A and gelatin D were used were as shown below.

| Gelatin | Reflection density | Transmission density |
|---|---|---|
| A | 1.57 | 3.48 |
| D | 1.66 | 3.86 |

EXAMPLE 4

An image receptive material was prepared by coating the following composition on a polyethylene laminated paper sheet, 90 g/m$^2$ in basis weight, which had been treated with corona discharge, at a coverage of 2 g/m$^2$ of gelatin, and drying. The test specimen was conditioned at 70% RH for 24 hours and then heated at 40° C. for 7 days.

| | |
|---|---|
| Gelatin | 20 g |
| Water | 300 ml |
| Nickel sulfide colloidal solution (5 mM/liter) | 40 ml |
| 1-Phenyl-5-mercaptotetrazole (1% methanol solution) | 10 ml |
| 2,4-Dichloro-6-hydroxy-S—triazine sodium salt (5% aqueous solution) | 4 ml |
| Sodium dodecylbenzenesulfonate (5% aqueous solution) | 10 ml |

-continued

| | |
|---|---|
| | (Total 400 g) |

Gelatin E of 210 g in jelly strength and 4,800 ppm in calcium content was desalted to a calcium content of 2,500 ppm (gelatin F) and 600 ppm (gelatin G). Gelatin H of 320 g in jelly strength and 4,300 ppm in clacium content was desalted to 1,900 ppm (gelatin I) and 500 ppm (gelatin J). By using these gelatins, 6 image receptive materials were prepared.

A photosensitive material was prepared by providing on a polyethylene laminated paper sheet an undercoating containing carbon black to keep the material from halation, and applying on said undercoating a gelatino silver halide emulsion layer containing 1.5 g/m$^2$ (in terms of silver nitrate) of orthochlormatically sensitized silver chlorobromide (5 mole-% in silver bromide content) having an average grain size of 0.3$\mu$, 0.2 g/m$^2$ of 1-phenyl-3-pyrazolidone, 0.7 g/m$^2$ of hydroquinone, and 4 g/m$^2$ of gelatin. The emulsion layer was hardened with a hardener to keep the layer from any damage during the diffusion transfer processing. A diffusion transfer processing solution of the following composition was used.

| | |
|---|---|
| Water | 800 ml |
| Sodium hydroxide | 25 g |
| Anhydrous sodium sulfite | 100 g |
| Hydroquinone | 20 g |
| 1-Phenyl-3-pyrazolidone | 1 g |
| Potassium bromide | 3 g |
| Sodium thiosulfate | 30 g |
| 1-Phenyl-5-mercaptotetrazole | 0.1 g |
| Made up with water to | 1,000 ml |

The photosensitive material was correctly exposed using a process camera and an original bearing moderately distributed black areas. The emulsion layer of the exposed photosensitive material and the image receptive layer of the image receptive material were brought into close contact and the resulting assembly was passed through a processor provided with squeeze rolls and containing the diffusion transfer processing solution. Thirty seconds after the assembly had emerged from the squeeze rolls, the materials were pulled apart. The image receptive material was washed with water for about 30 seconds and dried. The reflection density of the black areas was measured by means of a reflection densitometer RD 519 of Macbeth Co.

TABLE 1

| Gelatin | Reflection density |
|---|---|
| E | 1.52 |
| F | 1.55 |
| G | 1.60 |
| H | 1.54 |
| I | 1.59 |
| J | 1.71 |

The image receptive material was immersed in said processing solution at 20° C. for 1 minute and a ball-pointed needle of 1 mm in ball diameter was moved along the surface of said material at a speed of 10 cm/second. The film strength was evaluated in terms of load (in g; average of 3 measurements) applied to the needle when a scratch was observed. The load was 80–120 g for gelatins E to G and 150–250 g for gelatins H to J. It is seen from the above results and the results shown in Table 1 that the test specimen of this invention, in which gelatin J was used, showed a high film strength, yet a high silver image density.

EXAMPLE 5

An image receptive material was prepared and treated in the same manner as in Example 4, except that the coating composition for the image receptive layer was coated on a piece of polyethylene terephthalate film. The results of transmission density measurement performed by using a transmission densitometer TD 504 of Macbeth Co. were as shown in Table 2.

TABLE 2

| Gelatin | Transmission density |
|---|---|
| E | 3.34 |
| F | 3.45 |
| G | 3.59 |
| H | 3.47 |
| I | 3.63 |
| J | 3.88 |

The film strength showed a tendency similar to that in Example 4. It is seen from Table 2 that the test specimen of this invention, in which gelatin J had been used, showed a tendency similar to that in Example 4 with respect to the transmission density.

EXAMPLE 6

Supports used in Examples 4 and 5 were coated with the following coating composition for image receptive layer.

| | |
|---|---|
| Gelatin | 16 g |
| Water | 250 ml |
| Product formed by heating 10% polyvinyl alcohol with ethylene-maleic anhydride copolymer | 40 g |
| Silver sulfide colloidal solution (5 mM/liter) | 40 ml |
| 1-Phenyl-5-mercaptotetrazole (1% methanol solution) | 10 ml |
| Formalin (5% aqueous solution) | 8 ml |
| Sodium lauryl sulfate (5% aqueous solution) | 10 ml |
| Adjusted to pH 5.5 | (Total 400 g) |

Test results obtained by using gelatin G and gelatin J were shown in Table 3.

TABLE 3

| Gelatin | Reflection density | Transmission density |
|---|---|---|
| G | 1.63 | 3.64 |
| J | 1.75 | 3.91 |

What is claimed is:

1. A non-photosensitive image receptive material which comprises at least a support and an image receptive layer containing a gelatin having a calcium content of about 1,000 ppm or less and contains physical development nuclei and a jelly strength of 280 g or above as determined by the method of PAGI.

2. An image receptive material according to claim 1, wherein the calcium content of the gelatin is 500 ppm or less.

3. An image receptive material according to claim 1, wherein the gelatin content of the total binder is one-third or more.

4. An image receptive material according to claim 3, wherein the gelatin content of the total binder is two-thirds or more.

5. A silver complex diffusion transfer process which comprises imagewise exposing a photosensitive material comprising a support and a silver halide emulsion layer and developing the exposed photosensitive material in close contact with the image receptive material which comprises at least a support and an image receptive layer which contains gelatin having calcium content of about 1,000 ppm or less and contains physical development nuclei in the presence of a silver halide solvent.

6. A process according to claim 5 wherein the calcium content of the gelatin is about 500 ppm or less.

7. A process according to claim 5 wherein the gelatin is a lime-treated gelatin.

8. A process according to claim 5 wherein the gelatin content of the total binder is one-third or more.

9. A silver complex diffusion transfer process which comprises imagewise exposing a photosensitive material comprising a support and a silver halide emulsion layer and developing the exposed photosensitive material in close contact with the image receptive material which comprises at least a support and an image receptive layer containing a gelatin having a calcium content of about 1,000 ppm or less and contains physical development nuclei and a jelly strength of 280 g or above as determined by the method of PAGI in the presence of silver halide solvent.

10. A process according to claim 9 wherein the calcium content of the gelatin is about 500 ppm or less.

11. A process according to claim 9 wherein the gelatin is a lime-treated gelatin.

12. A process according to claim 9 wherein the gelatin content of the total binder is one-third or more.

13. A silver complex diffusion transfer process which comprises imagewise exposing a silver halide emulsion layer which is added to the image receptive material which comprises at least a support and an image receptive layer which contains gelatin having a calcium content of about 1,000 ppm or less and contains physical development nuclei and developing the exposed emulsion in the presence of a silver halide solvent.

14. A silver halide complex diffusion transfer process which comprises imagewise exposing a silver halide emulsion layer which is added to the image receptive material which comprises at least a support and an image receptive layer containing a gelatin having a calcium content of about 1,000 ppm or less and contains physical development nuclei and a jelly strength of 280 g or above as determined by the method of PAGI and developing the exposed emulsion in the presence of a silver halide solvent.

* * * * *